United States Patent [19]

Hubbard

[11] 4,044,232

[45] Aug. 23, 1977

[54] ELECTRONIC COPY SELECTION CONTROLS FOR A DOCUMENT REPRODUCTION MACHINE

[75] Inventor: James Henry Hubbard, Boulder, Colo.

[73] Assignee: International Business Machines Corporation, Armonk, N.Y.

[21] Appl. No.: 651,987

[22] Filed: Jan. 23, 1976

[51] Int. Cl.[2] ..... G06B 27/06

[52] U.S. Cl. ..... 235/92 SB; 235/92 PE; 235/92 R; 355/14

[58] Field of Search ..... 235/92 SB, 92 CT, 92 AC, 235/92 SH, 92 PE; 355/14

[56] References Cited

U.S. PATENT DOCUMENTS

| | | | |
|---|---|---|---|
| 3,784,790 | 1/1974 | Hatanaka et al. | 235/92 SB |
| 3,801,805 | 4/1974 | Hatanaka et al. | 235/92 SB |
| 3,856,125 | 12/1974 | Post | 235/92 SB |
| 3,944,794 | 3/1976 | Reehil et al. | 235/92 SB |

*Primary Examiner*—Joseph M. Thesz
*Attorney, Agent, or Firm*—Herbert F. Somermeyer

[57] ABSTRACT

A multidigit position control register is set by a new control signal either after being reset to a reference state, after completion of a controlled machine function and receipt of a new control signal or when all digit positions contain significant control signals and a new control signal is received. A document reproduction machine controlled by the control register has enhanced operator convenience and copy throughput by disclosed interactions of such register and machine. It is preferred that a manually actuated keyboard supply the control signals.

33 Claims, 4 Drawing Figures

ELECTRONIC COPY SELECTION CONTROLS FOR A DOCUMENT REPRODUCTION MACHINE

BACKGROUND OF THE INVENTION

The present invention relates to document reproduction machines and particularly to electronic copy selection and related controls for a convenience copier type of document reproduction machine.

Xerographic and other forms of document reproduction machines have been used for years as convenience copiers, as well as for higher throughput of copy production, such as found in printing or publication centers. There has been a trend from the original relay and cam-operated machines to electronic controls, as well as program controls of such document reproduction machines. Adoption of electronic controls generally has provided a greater flexibility in controlling document reproduction machines. A further change is the adoption of keyboard input for selecting the number of copies to be made of a given original document. Such keyboard entry usually results in a serial transmission of digits to a shift register in a manner similar to that of entry into an adding machine or a pocket electronic calculator. Once the copy number has been inserted into the shift register, a clear button enables the shift register to be cleared for permitting insertion of a new number, a machine reset clears the number, or a powder down clears the number. Hence, to change the selection of the number of copies to be reproduced requires externally actuated clearing action followed by insertion of the new number.

In other machines the copy select register is counted to zero or one, destroying the selection. Such action requires a new selection for each copy run, an operator inconvenience to be arrested.

While the above features permit utilization of electronic circuits in controlling a document reproduction machine, the interaction between the operator and the document reproduction machine requires the operator to clear the selection before inserting a new one. Also, machine reaction to the selection has no affect upon the selection itself. For example, if a number of copies greater than the capacity of the machine is selected, a machine produces copies up to the capacity of the machine, then the machine has been put in a wait state. Upon the operator removing the copies from the collator or other unit, which is filled up, then the machine automatically resumes the copy run.

In summary, it is desired to enhance the convenience of the operator using a convenience copier while facilitating throughput with minimal attention of the operator.

SUMMARY OF THE INVENTION

It is an object of the invention to provide an electronic document reproduction machine having enhanced electronic control data entry controls for tending to minimize operator attention to details while controlling or limiting the operator selections to predetermined functions and copy quantities in accordance with design goals of the machine.

A feature of the invention is to keep a copy selection in a control register until a new selection is made or a timer has timed out upon non-use of the machine. Further, control circuits in the machine facilitate inserting new selections into the control register.

A document reproduction machine using the present invention preferably includes a multidigit position control register which receives control or value digit signals from a manually actuatable keyboard or other suitable source. Position means indicate the number of significant digit value signals contained in the control register. When the position means is in a nonreference state and the machine is operating, further entries into the register are inhibited. However, upon completion of a copy run, the position means is reset to a reference state enabling insertion of a new number into the control register. The signal contents of the control register are unchanged.

Further, in another aspect of the invention, register control means jointly respond to the position means indicating that all digit positions of the control register have significant value signals therein and the keyboard was actuated, a new value from the keyboard is inserted into the control register which is substituted for the present signal contents of such control register. The control register and the position means are selectively resettable to a predetermined state in accordance with predetermined machine operational conditions. As an example, when the machine is in a duplex copy production mode (images are impressed upon both sides of the copies being produced), the machine having an interim copy storage means of finite capacity limits the number of copies to be produced in a given run to the capacity of the interim storage means. If an operator selects a number of copies to be produced greater than such capacity, then the machine automatically alters the signal contents of the control register to the maximum capacity of the interim storage means. In a similar manner, a collator may be attached to the document reproduction machine. Such collator may have a limited number of bins, i.e., may accept a limited number of copies to be collated in a given set of copies. For example, a machine may have either a 25-bin collator or a 50-bin collator. In the event the 25-bin collator is attached to the machine, the maximum number of copies to be produced in the collate mode would be limited to 25. Similarly, for a 50-bin collator, the maximum number of copies is 50.

In another aspect of the invention, the keyboard entry produces value signals which are detected in accordance with a scanning counter and a comparison circuit. A closure counter integrator determines whether or not a sufficient actuation of the key occurs before a value signal is inserted into the control register. Similarly, the closure counter integrator measures contact break time for indicating that a key has been released. These counts gate the digit value selected by the scanning counter for insertion into the control register. Provisions are made for selecting one and only one digit value signal for each depression of the keyboard; i.e., a plurality of keys may be simultaneously depressed, but only one value signal will be transferred. Further, means are provided for ignoring insignificant zero digits, i.e., zeroes to the left of the first nonzero value signal.

The foregoing and other objects, features, and advantages of the invention will become apparent from the following more particular description of the preferred embodiment thereof, as illustrated in the accompanying drawing.

THE DRAWING

DETAILED DESCRIPTION

Figure 1:
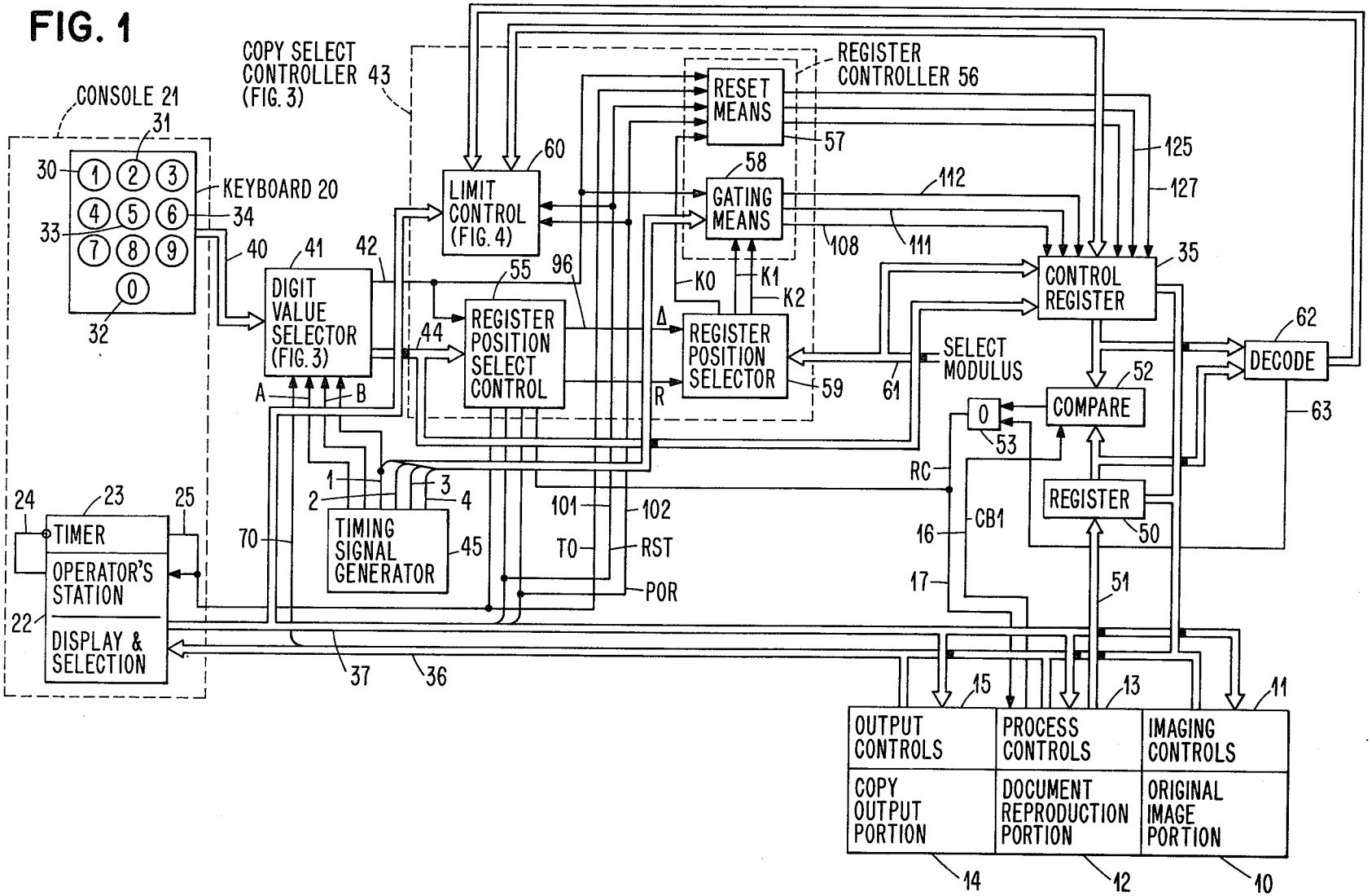
FIG. 1 is a diagrammatic and block diagram showing of a document reproduction machine incorporating the teachings of the present invention.

Referring now more particularly to the drawings, like numerals indicate like parts and structural features in the various diagrams. Overview of an illustrative embodiment of the invention is best seen by referring to FIG. 1. A document reproduction machine has an original image portion 10 controlled by a set of imaging controls 11. The image is obtained from an original document (not shown) placed on a platen (not shown) in the usual manner, and then projected upon an image area of a photoconductor member (not shown) or other document reproducing unit (not shown), all contained within a document reproduction portion 12 of the machine. Portion 12 is controlled by a set of process controls 13, all constructed using known techniques and in a known manner. The copies produced by the document reproduction portion 12 are transferred along a paper path (not shown) to a copy output portion 14 for accumulation or collation, as the case may be. Portion 14, in turn, is controlled by output controls 15. It is to be understood that the three controls 11, 13, and 15 have interconnections and interactions for coordinating and synchronizing the operations of all the portions 10, 12, and 14 with the movement of a photoconductor member (not shown) in document reproduction portion 12. A document reproduction machine of the type controllable by the circuits of the present invention include that shown in U.S. Pat. No. 3,834,807. It is also to be understood that other document reproduction machines may be similarly controlled, such as the so-called Copier II manufactured and sold by International Business Machines Corporation, Armonk, New York. Those machines do not have complete electronic controls. Rather, a timing shaft having cams thereon actuate switches (circuit breakers — CB's) to produce control signals called CB signals. Such CB signals synchronize the operation of all portions of the document reproduction machine. As an example, a CB1 signal is supplied by process controls 13 over line 16 for interrogating circuitry added to the document reproduction machine 10–15 for incorporating the present invention into such a machine. Such machines also have a turn-off signal, i.e., an indication that the number of copies to be made have been actually made. Such turn-off signal, as supplied over line 17 to process controls 13 initiate a shutdown of the document reproduction machine as is well known in the art and is not described for that reason. Exchanging signals between electronic circuits and relay circuits is well known and not described for that reason.

The present invention provides enhanced keyboard control 20 of the document reproduction machine 10–15 as well as enhancing control based upon signals received from communication circuits (not shown) and other automatic (not shown) or semiautomatic (not shown) control inputs. Such a keyboard 20 is usually mounted in a console 21 for the document reproduction machine 10–15. In addition to keyboard 20, the console includes operator station display and selection switches 22, as well as a timer 23 which deselects certain operator selections if the document reproduction machine 10–15 has not been used for a predetermined time. Such predetermined time will vary upon selection parameters of the document reproduction machine. In one machine 10–15, timer 23 had a time-out of 30 seconds. In another, 90 seconds timed out all of the selections. The timer 23 is reset by a signal traveling over line 24 from station 22 each time the machine is turned off. Of course, when the machine is running, a second signal on line 24 inhibits operation of tomer 23. When timer 23 has timed out, it supplies an actuating signal over line 25 for resetting the selections, as well as providing certain control functions in connection with the present invention, as will be later described.

Keyboard 20 can be of any design. However, it is preferred that the keying arrangement be as shown in FIG. 1. The numeral 1 is selected by the left-hand button 30, number 2 by button 32, etc., through button 32 which selects zero. An operator selects the number of copies to be produced by a succession of key depressions. For example, if 156 copies are to be produced, the operator depresses key 30 (selects 1), then the 5-indicating key 33, and then the 6-indicating key 34. The number 156 is then automatically inserted into control register 35 and suitably displayed in station 22 by signals supplied over cable 36 from control register 35. Such signals from register 35 are also applied to the controls 11, 13, and 15. Additionally, station 22 supplies selection control signals over cable 37 to the circuits of the present invention, as later described, as well as to the controls 11, 13, and 15, the latter in accordance with known design techniques.

The electronic circuits 41–62 illustrated in FIG. 1 are electrically interposed between keyboard 20 and control register 35 provide the enhanced functions of the invention as well as operator convenience and a more automatic control of copier 10–15.

Keyboard 20 key closure signals travel over cable 40 (having 10 circuits, one for each key) actuating digit value selector circuit 41 to detect the value of the key depressed, as well as integrating the closures and openings for eliminating noise and bounce caused noise signals. Selector 41 is described later in detail with respect to FIG. 3. Its functions include supplying a digit received signal over line 42 to actuate copy select controller 43 to insert a new data value into control register 35. The data values are supplied in binary coded decimal, or other coded form, over cable 44 to copy select controller 43 and to control register 35. Controller 43 examines the data signals on cable 44 for determining whether or not a significant value signal is being received. If no significant value signal is being received, then the data value signals are not inserted into control register 35.

Figure 2:
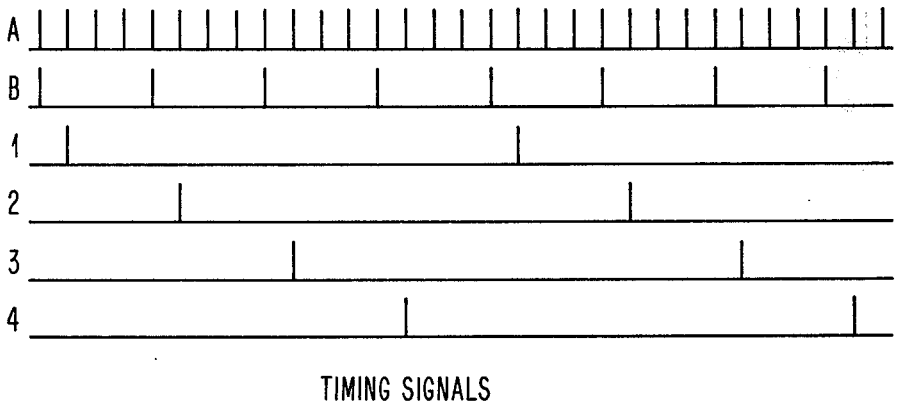
FIG. 2 is an idealized set of timing signals usuable to time the operation of the electronic circuits shown in FIG. 1.

A timing signal generator 45 synchronizes the operation of a portion of the illustrated electronic circuit 41–62. It provides a high-frequency signal A (see FIG. 2), a submultiple frequency B, and a set of four distributor pulses 1–4 for sequencing copy select controller 43.

Control register 35 is the same as a copy select register used in the Copier II, supra, and in other convenience copiers. That is, the signal content of control register 35 signifies the number of copies to be made in a copy set, i.e., how many times the original image is to be reproduced in a set of copies in a given copy run. A second register 50 receives signals over cable 51 from process controls 13 signifying the number of copies actually produced in a given set of copies. When the signal contents of register 50 equals the signal contents of register 35, the copy set is complete and the document reproduction machine is turned off by a signal supplied over line 17. To this end, compare circuit 52 responds to signals from control register 35 and from copy count register 50 to supply an RC (run complete) signal through OR circuit 53, thence to line 17 for turning the document reproduction machine 10–15 off. The RC signal is also supplied to copy select controller 43 for enabling a later described override input feature for control register 35.

Copy select controller 43 includes a register position select control 55 which detects the data on cable 44 for significant value and simultaneously controls register position selector 59. Register position selector 59 in turn controls register controller 56 for selectively inserting cable 44 signals into control register 35 and shift signal contents thereof to more significant digit positions. Register controller 56 includes reset means 57 which resets certain digit positions of register 35, as well as gating means 58 which selectively actuates control register 35 to receive the cable 44 data signals. Register position selector 59 indicates the number of significant digits in control register 35 and controls the gating means 58 and the reset means 57 for employing an override function and data value insertion principles of the present invention. Limit control 60 limits the number of copies in a copy set by selectively altering the signal contents of control register 35 in accordance with functional capabilities of the document reproduction machine 10–15, as described in detail with respect to the showing in FIG. 4. Limit control 60 and the select modulus signals received over cable 61 provide additional controls on automatically limiting the number of copies in a given copy set in accordance with selections beyond the control of the operator.

Decode circuit 62 examines the signal contents of control register 35 and register 50 for illegal signal patterns and for detecting when the signal contents of register 50 has a numerical value greater than the numerical value contained in control register 35. In the latter case, a stop signal is supplied over line 63 through OR circuit 53 to turn off the document reproduction machine 10–15. Additionally, an alarm may be sounded, or a suitable indicator (not shown) is illuminated within station 22. Decode 62 also supplies control register 35 decoded signals indicating the magnitude of the value signals in that register. Limit control 60 responds to those signals for determining whether or not the signal contents of register 35 should be altered to coincide with the functional capabilities of document reproduction machine 10–15.

Figure 3:
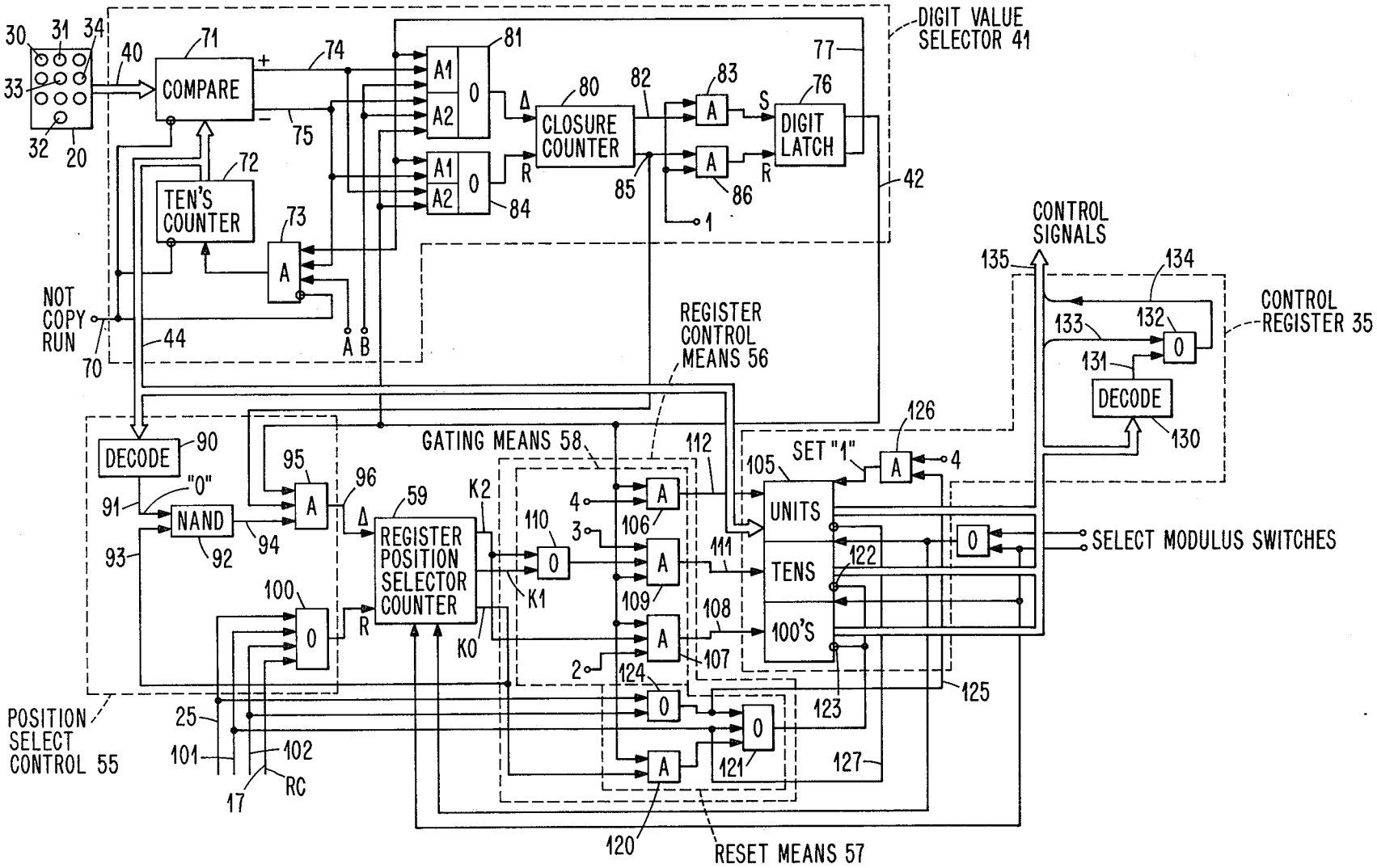
FIG. 3 is a combined block and signal flow diagram showing a digit value selector and a copy select controller usable with the FIG. 1 illustrated document reproduction machine.

Referring now more particularly to FIG. 3, digit value selector 41 is detailed. Selector 41 is enabled only when process controls 13 are supplying a not copy run signal over line 70 which enables compare circuit 71, decade or 10's counter 72, and AND circuit 73. 10's counter 72 scans the key selections received by compare circuit 71. The scan is operated at the rate by A pulses poking through AND circuit 73 to continually increment counter 72. When compare circuit 71 detects a coincidence between the numerical content of counter 72 and the decoded value of a key closure activated line in cable 40, compare circuit 71 latches the comparison and supplies an active signal over line 74 for initiating a determination of whether or not a sufficient contact closure is occurring. At all other times, compare circuit 71 supplies a noncompare indicating signal over line 75 which partially enables AND circuit 73 to pass the A pulses. Digit received indicating latch 76 being reset supplies a no-digit received signal over line 77 for completing control of AND circuit 73. Accordingly, counter 72 counts the A pulses until compare circuit 71 removes the line 75 signal, at which time the value signals are generated in counter 72 in correspondence with closure of a key in keyboard 20. The signal contents of counter 72, which is preferably in binary coded decimal, but may be in straight binary or other number notational system, supplies the resultant value signals over cable 44 as mentioned with respect to FIG. 1.

Digit value selector 41 also selects one and only one set keyboard 20 selected value signals. If two keys are simultaneously actuated, selector 41 supplies value signals corresponding to but one key. Such action is achieved by the ten's counter 72 scan. The scan is interrupted upon compare circuit 71 detecting a comparison with any key. The first successful comparison stops the scan and initiates inserting a value signal into control register 35. All other selections are excluded. Hence, which key is received is a random function of the scan position (count in counter 72) and time of keyboard actuation.

Closure counter 80 determines a satisfactory closure or opening of a keyboard 20 key. A pair of AND/OR (AO) circuits 81 and 84 control closure counter 80. To detect a closure, the A1 input portion of AO (AND-/OR) 81 is enabled to pass B pulses to increment closure counter 80 from a reference state, such as all 0's. When closure counter 80 is counted to a predetermined number, for example, 78, counter 80 then supplies an activating signal over line 82 enabling AND circuit 83 to pass a distributor 1 pulse for setting digit latch 76. Hence, 78 B pulses define a satisfactory closure of a keyboard 20 key. Circuitwise, the A1 portion of AO 81 is enabled to pass the B pulses when digit latch 76 is reset and when compare 71 is supplying a successful compare signal over line 74.

In a similar manner, a contact opening is detected by closure counter 80 counting to 73 "B" pulses. To this end, the A2 input portion of AO 81 receives the B pulses whenever compare circuit 71 is supplying a noncompare active signal over line 75 and digit latch 76 has been set; i.e., a digit has been successfully received from keyboard 20. Now, closure counter 80 has to detect release of the key by counting to decimal 73. When closure counter 80 reaches count 73, it supplies an active signal over line 85 enabling AND circuit 86 to reset digit latch 76.

Intermediate the above-described counting activity, counter 80 is reset by AO 84. The AO 84 input portion responds to digit latch 76 being in the reset state, as indicated by the active signal on line 77 and to compare circuit 71 supplied active signal over line 75 to reset closure counter 80. That is, when digit latch 76 indicates no digit has been received and compare circuit 71 signifies no key is closed, i.e., all keys are open, then closure counter 80 can be reset for detecting the next closure;

i.e., count to decimal 78. In a similar manner, the A2 input portion of AO 84 responds to digit latch 76 set indicating signal on line 42 and the compare 71 comparison signal received over line 74 to reset counter 80. This detection signifies that compare circuit 71 has detected a contact closure and that counter 80 already has counted to 78 and set digit latch 76. Accordingly, counter 80 should be reset for conditioning the circuits to detect a contact opening. In summary, in accordance with the above detection processes, selector 41 supplies a digit received indication signal on line 42 and the corresponding detected value signals over cable 44.

Before entering the value signals on cable 44 into control register 35, position select control 55 determines whether or not a new significant data value has been received. Decode 90 detects for an all-0's indication of a cable 44 signal. If a zero is detected, it supplies an activating signal over line 91 to NAND circuit 92. If the register position selector counter 59 is already in the later described KO state, i.e., there are no value signals in register 35 or an override, as later described, is enabled, an active signal on line 93 completes actuation of NAND 92. NAND 92 then supplies an activating signal over line 94 to activate AND circuit 95. AND circuit 95 only passes an incrementing signal over line 96 for incrementing the position selector counter 59, as later described, when digit latch 76 is set, as indicated by the line 42 signal, and closure counter 80 has detected a key opening, as indicated by the line 85 signal being active. These conditions indicate significant digit value signals in cable 44. Incrementing counter 59 only under those conditions also suppresses entry of nonsignificant zeroes, i.e., the all zeroes to the left of the first nonzeroes digit. Hence, for all nonsigificant zeroes, the line 96 signal remains quiescent. It should be remembered that for significant zeroes, i.e., zeroes to the right of nonzero digits, this action results in an activation of line 96 in that counter 59 is in a nonzero count state.

Position select control 55 also resets position counter 59 to the zero or reference state KO via OR circuit 100. OR circuit 100 passes all resetting and clearing signals received from station 22 and process controls 13 to reset register position counter 59. The reset signals include a reset signal from line 101. Reset is a key in station 22 which resets all electronic circuits within the machine, including those circuits and relays in controls 11, 13, and 15. Additionally, the timer 23 signal on line 25 time-out signal (TO) resets counter 59. A power-on reset signal (POR), received over line 102 from station 22, resets counter 59, as well as control register 35. For control register 35 override, counter 59 is reset by the RC signal on line 17 without resetting control register 35. This override enables the operator to insert a new set of value signals or control signals into register 35 without depressing either a reset button or a clear button. That is, at the end of a copy run, the present invention enables the operator to select a new number of copies to be produced without manually resetting control register 35.

The override facility mentioned above is best understood by understanding the functions of the register position selector counter 59. Counter 59 has a number of count states equal to the number of digit positions in control register 35. Counter 59 can either be a shift register counter or a three-state binary counter. The First state, K0, is a reference state signifying that the first received digit signal from keyboard 20 is to be assigned to the units digit position of control register 35 and the more significant digit positions, 10's and 100's, contain nonsignificant zeroes. The second signal state, K1, signifies there is a value signal in the unit digit position and that the next received signal from keyboard 20 should be put in the units digit position, and that the significant value signal contents of the units digit position should be shifted to the 10's digit position. The 100's digit position has a nonsignificant zero. Similarly, the K2 state, the third state, signifies that the units and 10's digit positions contain signals and that the next received signal from keyboard 20 signifies that those two signals should be shifted to a more significant digit position and the newly received signal be inserted in the units digit position. When control register 35 is cleared to its reference state, counter 59 is always in the K0 state. Upon override, control register 35 contains value signals and still the next received value signal from keyboard 20 will replace all of the signal contents of control register 35. That is, the copy number selection contained in register 35 can be overridden by actuation of the keyboard without any intervening action by the operator.

Gating means 58 respond to the K0, K1, K2 counter states of counter 59 to achieve the shifting and data insertion into control register 35. Control register 35 includes a decimal shift register 105 having the units, tens, and one hundreds digit positions. It is preferred that register 105 contain signals in the binary coded decimal notation, no limitation thereto intended. Cable 44 is connected to all of the unit digit positions and may consist of four D-type flip-flops wherein the data signals on cable 44 are attached to the data input of the respective D-type latches while the gating means 58 control signals are connected to the clock inputs. To this end, AND circuit 106 of gating means 58 controls insertion of data signals from cable 44 into the units digit position.

The sequence of inserting signals into register 105 is best understood by referring to the distributor pulses 1–4. Distributor pulse 1 detects receipt of a digit value by sampling circuits 83 and 86 of digit value selector 41. The circuits are then conditioned for detecting the action required for inserting the received value signals or for inhibiting the received value signals. In the event signals reside in the units and tens digit positions of register 105, AND circuit 107 responds to the 2 distributor pulse and to the K2 indicating state of counter 59, as well as the line 42 active signal to shift the signal contents of the tens digit position to the hundreds digit position, all as indicated by line 108. Such shifting is achieved by circuitry (not shown) contained within register 105 as is well known in the arts. Then, at distributor time 3, AND circuit 109 responds to the 3 pulse, line 42 pulse, and to OR circuit 110 to shift the signal contents of the units digit position to the tens digit position, as indicated by the line 111. This action is identical to the shift from the tens to the hundreds digit position. OR circuit 110 passes the activating signals indicating the K1 or the K2 state; that is, the units digit position signals are supplied to the tens digit position whenever any value signal is in the units digit position. Finally, AND circuit 106 responds to the 4 distributor pulse and to the line 42 pulse to activate the C inputs of the D latches (not shown) to the units digit position 105 as indicated by line 112.

Reset means 57 cooperates with counter 59 and the other previously indicated reset control signals for resetting and conditioning control register 35 to reflect the desired number of copies to be produced. The override feature enabled by counter 59 being reset to the K0 state by the RC line 17 signal includes activating AND circuit 120 whenever the digit latch 76, line 42, signal occurs simultaneously with the counter 59 K0 state. AND circuit 120 supplies its activating signal through OR circuit 121 for resetting the tens and hundreds digit positions of register 105 as signified by the small circles 122, 123. Then, in the next distributor 4 time, AND circuit 106 inserts the received value signal from cable 44 into the units digit position. The tens and hundreds digit positions of register 105 are also reset by OR circuit 121 in response to a line 101 reset signal and whenever OR circuit 124 receives either the POR signal on line 102 or the TO signal on line 25. OR circuit 124 supplies its signal over line 125 for also setting the units digit position to a 1 signal state. This is done in coincidence with a 4 distributor signal pulse via AND circuit 126. The line 101 reset signal also supplied over line 127 resetting the units digit position of register 105 to zeroes.

Another feature of the illustrated document reproduction machine is that whenever the control register 105 indicates all 0's, the document reproduction machine produces one copy per copy run. In certain prior art machines, an all-0's in the copy select register or dial resulted in no copies being produced. To make it more convenient for the operator, i.e., not requiring the operator to insert a 1 in the copy select register, a decode circuit 130 responds to an all-0's condition in register 105 to generate an active signal on line 131. OR circuit 132 combines the line 131 signal from the 1 indicating line from the units digit position of register 105 to supply a 1 signal over line 134. The line 134 signal not only signifies to the document reproduction 10–15 to produce one copy, but also is the best significant bit of register 105 copy select control signals for a copy run of more than one copy.

Figure 4:
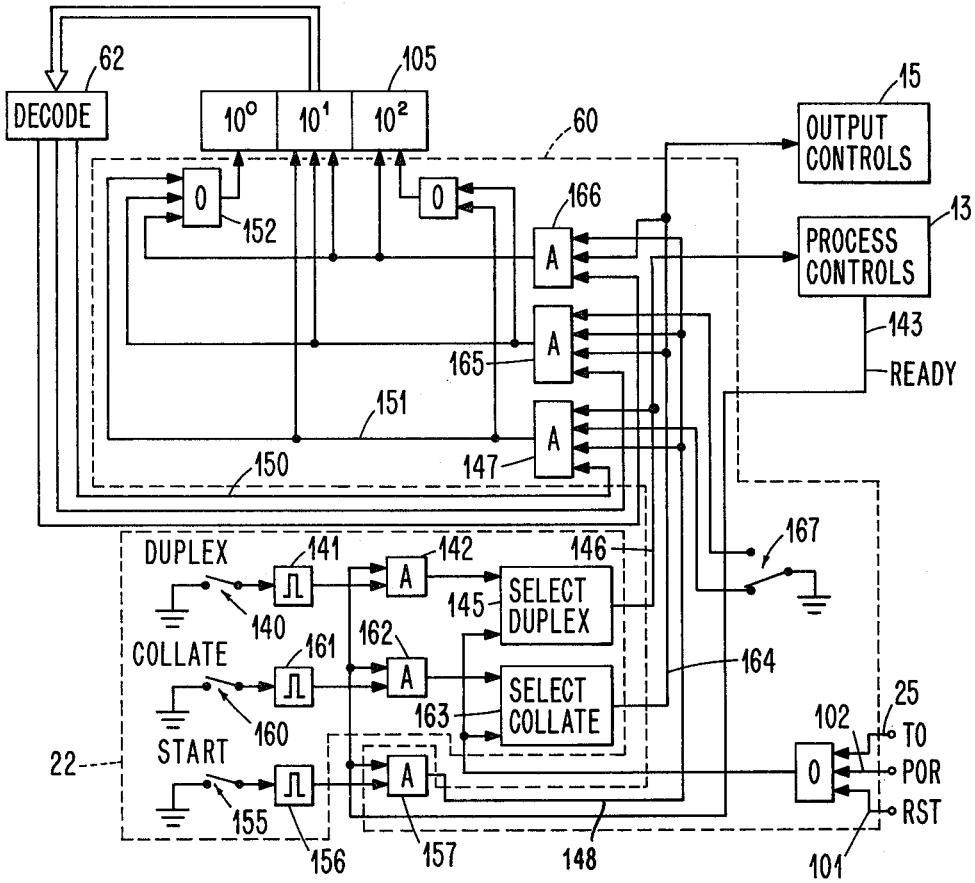
FIG. 4 is a simplified combined block and signal flow diagram of a limit control usable with the FIG. 1 illustrated document reproduction machine.

Referring now more particularly to FIG. 4, limit control 60 and its interaction with the remaining portions of the machine is detailed. In some constructed embodiments of the document reproduction machine 10–15, copy handling facilities may be limited. For example, in a duplex mode wherein images are printed on both sides of copy paper, an interim storage unit (not shown) is provided within document reproduction portion 12. This interim storage unit (not shown) may have a capacity of storing 125 copy sheets, for example. In the event that the copy select or control register 35 signifies in the duplex mode that 200 copies are to be produced, the capacity of the interim storage unit will be exceeded. As a result, paper jams or error conditions may result. A similar situation may occur when a collator is included in copy output portion 14. That is, the number of copies in the copy set should not exceed the number of bins in the attached collator. FIG. 4 illustrated circuits obviate these problems by limiting the content of register 105 to the maximum capacity of the critical element in the document reproduction machine involved in a particular copy run.

Station 22 includes a duplex selection switch 140 which, when closed, actuates pulse former 141 to sample AND circuit 142. AND circuit 142 is enabled to pass the pulse former 141 signal whenever process controls 13 indicate that operator selections are ready to be received by a signal on line 143. Line 143 forms a portion of cable 36 in FIG. 1 connecting process control 13, inter alia, to station 22. AND circuit 142 triggers select duplex trigger 145 to the duplex indicating state. Duplex trigger 145 then supplies a duplex indicating signal to process controls 13 and to limit control 60 over line 146. AND circuit 147 in limit control 60 responds to the line 146 signal and to a start signal (later described) received over line 148 and to a decode 62 signal on line 150 signifying register 105 has signal content greater than the capacity of the interim storage means (not shown) to supply an active signal over line 151. The line 151 signal adjusts the signal content of register 105 to the maximum capacity of the interim storage means (not shown), for example, 125. This is achieved via OR circuit 152 supplying a 5 setting signal to the units digit position $10^0$ and by the line 151 signal supplying a 2 setting signal to the units digit position $10^1$ and a 1 setting signal to the hundreds digit position $10^2$. Upon setting register 105 to 125, document reproduction machine 10-15 produces 125 copies in a successful manner without overloading any portion of the machine. Upon completion of the production of 125 copies, the operator then may insert the appropriate number of copies remaining to be made in register 105.

Register 105 is preset as above described by one of several means. As shown in FIG. 4, closure of start switch 155 actuating pulse former 156 passes a pulse through AND circuit 157 whenever the line 143 signal is active. AND circuit 157 then supplies the above-mentioned line 148 signal. In the alternative, process control 13 may supply one of its CB pulses for interrogating AND circuit 157. Yet other sources of interrogation pulses may be used.

A similar situation occurs when the collate mode is selected by closing switch 160. Pulse former 161 supplies the collate select indicating pulse to AND circuit 162 which is enabled by the line 143 signal. Select collate trigger 163 is then triggered to the collate state. The select collate signal supplied over line 164 goes to the output controls 15 for controlling the copy output portion 14. Line 164 signal also samples AND circuits 165, 166 of limit control 60. These AND circuits are selectively further enabled by the setting of single-pole, double-throw switch 167. For example, if there is one collator module of 25 bins, then switch 167 is set to activate AND circuit 165 and deactivate AND circuit 166. On the other hand, if there are two collate modules having a total of 50 collate bins, AND circuit 166 is activated to the exclusion of AND circuit 165. The start signal from AND 157 samples both AND circuits, one of which is enabled during the collate mode for presetting register 105 to either 25 or 50 (AND circuit 165, 166, respectively) whenever decode 62 signifies to the AND circuit 165 and 166 that the signal content of register 105, respectively, exceeds 25 or 50. In the above-described manner, document reproduction machine 10–15 is controlled by electronic circuits for facilitating operator control while imposing facility capability restrictions on operator selections.

The initial condition of the document reproduction machine 10–15 and of the illustrated electronic circuits is determined by the reset signals and the POR signals, respectively, on lines 101 and 102. Resetting station 22 via OR circuit 170 resets the select duplex trigger 145 and the select collate trigger 163 to the nonduplex and noncollate indicating states. Accordingly, the first closure of either switches 140 or 160 will trigger the respective triggers to the duplex or collate indicating modes. Subsequent closures trigger those latches 145 and 163 back to the nonduplex and noncollate states, respectively. The time-out signal TO on line 125 also resets the triggers 145 and 163 for deselecting the operator selections of station 22. It is to be understood that in some document reproduction machines the duplex mode may be the normal mode. Such a situation resets OR circuit 170 connecting it to the set side of trigger 145 and not the reset side.

While the invention has been particularly shown and described with reference to a preferred embodiment thereof, it will be understood by those skilled in the art that various changes in form and detail may be made therein without departing from the spirit and scope of the invention.

What is claimed is:

1. A document reproduction machine having controllable sequencing means, said sequencing means supplying signals indicating machine signal states, a keyboard for serially entering control value digit signals, each said control digit signal capable of having a value of a nonsignificant zero or one of a plurality of significant values, a control register for receiving said control digit signals, said register having a given number of signal receiving digit positions, having a given modulus and capable of assuming any one of a plurality of signal control states including a reference signal state, said machine capable of producing a number of copies of one image in one copy run in accordance with the signal contents of said control register, the improvement including in combination electrical means electrically interposed between said keyboard and said control register, and including:

digit value selector means limiting each keyboard actuation to selecting one and only one value and for supplying value signals indicative of said selected one value;

gating means for enabling gating and shifting said value signals to predetermined digit positions of said control register;

register position indicating means indicating the number of digits in a set of significant value signals in said control register and controlling said gating means in accordance therewith;

reset means responsive to first predetermined one of said signal states to reset said control register to said reference signal state for actuating said machine to produce copy per copy run; and position select control means responsive to a second predetermined one of said signal states to reset said register position indicating means to a reference state for enabling said keyboard to enter significant digit value signals into said control register without first separately clearing said control register.

2. The machine set forth in claim 1 wherein said machine has a plurality of functional units, said machine being capable of selectively using said functional units, predetermined ones of said functional units having respective number of copy handling capabilities less than said given modulus;

the improvement further including in combination:

selection means indicating that a first one of said functional units is selected to be used;

a decoder connected to said control register for detecting and indicating a signal contents therein greater than said respective number of copy handling capability; and circuit means responsive to said selection means and said decoder to set said control register to a number not greater than said respective number of copy handling capability.

3. The machine set forth in claim 2 further including machine run indicating means;

the combination further including said circuit means being responsive as set forth in claim 2 only when said machine run means indicate a copy run has been started.

4. The machine set forth in claim 2 further including mode selection means operatively associated with said first functional unit for selecting same to be actuated; and said circuit means including a plurality of functional unit circuit portions responsive to said mode selection means to respectively respond to only one of a like plurality of said functional units and respective signals from said keyboard to set said control to a respective one of said number of copy handling capabilities.

5. The machine set forth in claim 1 wherein said reset means first means to reset said control register to a unity signal state as said reference signal state and second means to reset said control register to a zero signal state; and circuit means connected to said control register and responsive to said control register being in either said unity or zero signal states to supply a unity indicating signal such that for either of said unity or zero signal states one copy is produced in a copy run.

6. The machine set forth in claim 1 wherein said reset means includes override reset means responsive to said register position indicating means being in a reference state and to said digit value selector means for resetting at least all digit positions of said control register except the least significant digit position whereby a one of said value signals of said digit value selector means entered into said control register by said gating means becomes the only significant value signal in said control register.

7. The machine set forth in claim 6 further including inhibit means in said position select control means inhibiting said register position indicating means from actuating said gating means inserting of nonsignificant zero indicating value signals into said control register.

8. The machine set forth in claim 6 further including a copy count register indicating number of copies produced in a given copy run;

compare means responsive to said control register and said copy count register to indicate end of said given copy run;

circuit means in said position select control means responsive to said end of run indication to reset said register position indicating means to a reference control state to indicate that a next entered value signals to said control register are to be the only value signals therein while presently leaving any significant value signals in said control register whereby said keyboard can be actuated to override signal contents of said control register with a single actuation.

9. The machine set forth in claim 8 wherein said register position selector means has a number of signal control states equal to the number of digit positions of said control register, one said control state being said reference control state, and all others of said signal control state indicating which digit position of said control register contains a most significant digit of signal content of said control register.

10. The machine set forth in claim 9 further including means connected to said register position selector means limiting the number of said signal control states to a number less than said number of digit positions in said control register.

11. The machine set forth in claim 1 wherein said digit value selector means includes:

a closure counter having a plurality of signal count states and supplying first and second count outputs, said closure having a reference count state, said second count output being numerically less than said first count output;

means responsive to said keyboard to indicate a possible key closure and a possible key opening;

timing signal means supplying a plurality of timing signals of different phase and frequency;

a digit latch;

first and second detectors respectively responsive to said first and second count outputs to respectively set and reset said digit latch;

a first gating control circuit jointly responsive to said keyboard responsive means respectively indicating a closure and an opening and to said digit latch respectively being in said reset and set states to enable said closure counter to count toward said first and second counts from said reference count state; and a second gating control circuit jointly responsive to said keyboard responsive means and to said digit latch respectively being in said set and reset states to reset said closure counter to said reference count state.

12. The machine set forth in claim 1 wherein said digit value selector means further having a keyboard closure-opening detector for indicating a key closure and a key opening;

a digit latch responsive to said closure-opening detector to memorize a closure in a set state and an opening in a reset state; and said gating means and said position selection control means being responsive to said digit latch being in said set state to gate said value signals to said control register and to actuate said register position indicating means to indicate one move received digit.

13. The machine set forth in claim 12 further including a time meter electrically interposed between said closure-opening detector and said digit latch and having means responsive to said closure-opening detector to indicating a closure to time out to a first delay before setting said digit latch and having means responsive to said closure-opening detector indicating all keys open to time out to a time delay less than said first delay before resetting said digit latch to indicate a key opening.

14. The machine set forth in claim 1 wherein said digit value selector means includes closure-opening time out means requiring a first time to indicate a closure and a second time less than said first time to indicate an opening.

15. The machine set forth in claim 14 further including:

a digit latch responsive to said first time out to assume a set state and to said second time out to assume a reset state; and gating means in said closure detection means responsive to said digit latch for resetting same to a reference state for enabling said time outs.

16. The machine set forth in claim 1 further including closure detection means in said digit value selector responsive to continuous ones of said each keyboard actuation-deactuation respectively to time a first time out before indicating a key closure and a second time out less than said first time out to indicate a key opening.

17. The machine set forth in claim 1 further including:

modulus selecting means connected to said register position indicating means for limiting said number of digits to a predetermined number not greater than the number of digit positions in said control register.

18. The machine set forth in claim 1 further including modulus selecting means connected to said control register for inhibiting insertion of significant control value signals to a predetermined ones of said signal receiving digit positions.

19. A document reproduction machine having a settable copy select register and operable in a succession of copy production runs;

means for resetting said copy select register to a reference state for producing a single copy during a given copy production run of said document reproduction machine;

means for starting said given copy production run in said machine;

means responsive to said starting means and said copy select register to actuate said machine to produce a number of copies indicated by said copy select register and further having means responsive to said copy select register being reset to zero and to said starting means to actuate said machine to produce a single copy during said given copy run;

means indicating an end of said given copy run;

means responsive to said indicating means enabling inserting a number into said copy select register without first clearing same or otherwise altering signal contents thereof; and manually actuated keyboard means operative with said responsive means to insert a number into said copy select register.

20. A document reproduction machine operable in a succession of copy runs and having a plurality of portions, one of which can be selectively operated with other ones of said portions;

means selecting operation of said one portion, said one portion having a capability to handle a first number of copies in a given run;

a control register storing signals indicating a number of copies to be made in said given run; and means responsive to said selecting means to automatically alter said indicated number in said control register to said first number whenever said indicated number exceeds said first number.

21. A document reproduction machine having document production control means;

sequencing means indicating document production states;

input means for serially entering significant control digit signals into said machine;

a control register having plural digit positions for receiving said significant control digit signals, including a least-significant digit position for receiving said control digit signals and a most significant digit position and connected to said sequencing means for controlling same, each of said digit positions capable of being set to one of a plurality of significant value signal states; and register control means electrically interposed between said input means and said control register, and being jointly responsive to a predetermined nonzero one of said signal states and said input means supplying a new value signal to insert said entered significant control digit signal into said control register to substitute such significant control digit signal for the entire present value signal contents of said control register and otherwise serially supplying said entered significant control digit signals into said least-significant digit position and means responsive to said register control means during said otherwise serial supply of entered significant control digit signals to shift significant control digit signals stored in said control register respectively to a more significant digit position whenever said least-significant digit position is serially supplied said entered significant control digit signal.

22. The document reproduction machine set forth in claim 21, said register control means including:

position indicating means for indicating when significant value signals are in said most significant digit position and having a reference signal state;

means responsive to a one of said entered significant value signals to actuate said position indicating means to said reference signal state; and reset means responsive to said reference signal state and said received significant value signals to reset said control register for receiving and storing said received significant value signals to the exclusion of other previously received significant value signals.

23. The machine set forth in claim 21 wherein said input means is a keyboard; and digit value selector means responsive to said keyboard to serially send said control digit signals to said control register.

24. A document reproduction machine having a multidigit position control register having a most significant and a least-significant digit position, and being operable in a succession of copy runs;

control input means for serially supplying digit value signals;

position means indicating the number of significant digit value signals in said control register including a significant digit value signal or no such significant digit value signal in said most significant digit position and having a reference state indicating a significant digit value is stored in said most significant digit position;

means indicating completion of a copy run for resetting said position means to a reference control state independent of signal contents of said most significant digit position for indicating that next received digit signals shall be the only digit value signals in said control register; and register control means jointly responsive to said position means being in said reference control state and said control input means being actuated to substitute a supplied new digit value signal for the entire present digit value signal contents of said control register and having means responsive to said indication of no significant digit value signal in said most significant digit position and said control input means being actuated to insert a new supplied digit value signal into said least-significant digit position of said control register while moving any stored significant digit value signals to a more significant digit position.

25. The machine set forth in claim 24 wherein said control input means is a manually actuated keyboard and circuit means electrically interposed between said keyboard and said control register to limit insertion of but one digit indicating value signal at a time to said control register.

26. The method of operating a document reproduction machine, including the steps of:

first selecting a predetermined number of copies to be produced by the machine in a given run;

storing said predetermined number in a multidigit register having a most significant digit position;

detecting when said selected number of copies exceeds a given number of copies capable of being temporarily stored in one portion of said document reproduction machine;

producing said given number of copies during said given run;

detecting and indicating when said most significant digit position contains a nonzero portion of said perdetermined number;

replacing the entire numerical contents of said multidigit register with a newly entered digit of a given number as a predetermined number replacing said first selected predetermined number whenever said most significant digit position is storing a nonzero digit value;

producing a number of copies in a given run in accordance with the contents of said multidigit register;

electronically memorizing said predetermined number in a multidigit register having a most significant digit position;

inhibiting changing said predetermined number in said multidigit register during said given run; and upon completion of said given run, automatically maintaining said predetermined number in said multidigit register, removing said inhibition and conditioning said machine to automatically substitute for said predetermined number a new selection whenever a new selection is made without first erasing said predetermined number.

27. The method set forth in claim 26 further including the steps of:

sensing said selection to ascertain the number of significant digits in said predetermined number; and when said sensed number of digits is a certain number, then erasing said predetermined number upon receipt of a new selection.

28. A document reproduction machine having a copy production portion, a control register having a predetermined number of digit positions for indicating to said document production portion a number of copies to be produced in a given run and having a reference signal state;

the improvement including in combination:

input means for supplying a series of digit indicating signals;

a digit value selector responsive to said input means to detect and indicate a supplied one of said digit indicating signals;

a counter with a reference count state and having a modulus equal to said predetermined number and being reentrant such that a count equal to the modulus returns said counter to its original count state, means for originally setting said counter to said reference count state;

position control means responsive to said selector to indicate said supplied one of said digit indicating signals as representing significant value and including means incrementing said counter for each said significant value representing supplied one of said digit indicating signals; and gating means electrically interposed between said input means and said control register and being responsive to said counter to transfer said supplied one of said digit indicating signals to said control register in accordance with a count state of said counter.

29. The document reproduction machine set forth in claim 28 further including:

reset means having means to reset said control register and said counter to said reference states, respectively; and means responsive to said copy production portion to reset said counter to said reference count state.

30. The document reproduction machine set forth in claim 29 further including:

means limiting the modulus of said counter to less than said predetermined number whereby less than all of said digit positions of said control register will ever contain significant ones of said supplied one of said digit indicating signals.

31. A document reproduction machine having a copy production portion operable in a succession of copy runs;

a multidigit position control register connected to said copy production portion and for containing number indicating signals for instructing said copy production portion to produce a like number of copies in a given run, said control register maintaining said contained number indicating signals;

input means for supplying number indicating signals;

first circuit means for receiving said supplied number indicating signals for inserting same into said control register;

second circuit means responsive to said copy production portion for enabling said first circuit means to insert new number indicating signals into said control register in a predetermined timing relationship to said given copy run; and third circuit means responsive to said copy production portion being inactive a predetermined time to reset said control register to a reference number indicating state for instructing said copy production portion to produce a single copy in a copy run, whereby a given one signal contents of said control register are maintained therein from copy run to copy run subject to input means supplying number indicating signals after said given run in said copy production portion has been inactive said predetermined time.

32. The document reproduction machine set forth in claim 31 wherein:

said input means consists of a manually actuated keyboard;

an operator station having a plurality of manually actuated switches for selecting modes of operation of said copy production portion;

electronic circuit means memorizing said manually selected modes of operation; and said third circuit means includes means resetting said electronic circuit means simultaneously with resetting said control register whereby said document reproduction machine is in a reference operational state after said predetermined time of inactivity.

33. The method of operating a document reproduction machine having a copy production portion and being operable in a succession of copy runs, the steps of:

first, manually selecting a first number of copies to be produced, electronically memorizing said selected first number of copies;

manually selecting one of a plurality of modes of operation for said copy production portion, electronically memorizing said selected modes of operation;

tallying the number of digits in said selected number of copies to be produced, when said tallied number of digits equals a predetermined number, enable another of said manual selections of said number of copies to be inserted into said machine without first manually erasing the first mentioned manual selection of said number of copies;

manually actuating said machine to perform one copy run; and after said manual actuation and while maintaining said first manual selection of a first number of copies for use in a subsequent copy run, enabling a second manual selection of a second number of copies without manually erasing said first manual selection.

* * * * *